United States Patent [19]

Smaw

[11] 4,203,584

[45] May 20, 1980

[54] METHODS AND APPARATUS FOR INTERFOLDING BUNDLES OF INTERFOLDED WEBS

[75] Inventor: Jesse B. Smaw, East Paterson, N.J.

[73] Assignee: Marcal Paper Mills, Inc., Elmwood Park, N.J.

[21] Appl. No.: 883,299

[22] Filed: Mar. 3, 1978

[51] Int. Cl.[2] ..... B41L 1/30

[52] U.S. Cl. ..... 270/40

[58] Field of Search ..... 270/39–40

[56] References Cited

U.S. PATENT DOCUMENTS

| | | | |
|---|---|---|---|
| 3,845,948 | 11/1974 | Furbeck | 270/40 |
| 4,061,325 | 12/1977 | Marcalus | 270/40 |

*Primary Examiner*—Clifford D. Crowder
*Assistant Examiner*—A. Heinz
*Attorney, Agent, or Firm*—Burns, Doane, Swecker & Mathis

[57] ABSTRACT

First and second bundles of interfolded webs are formed. The uppermost web half of the first bundle is interfolded with the lowermost web half of the second bundle at a merging station. These web halves travel along parallel and inclined fold surfaces and become interfolded upon being discharged therefrom. To unfold the uppermost web half for travel along its associated fold surface a freely rotatable roller is positioned upstream of such fold surface. The roller is arranged to be contacted and frictionally driven by the uppermost web half. The roller is oriented toward the fold line of the uppermost web half so that upon driving the roller, the uppermost web half becomes unfolded. To promote unfolding of the lowermost web half of the second bundle a stationary elongate band is disposed between the lowermost web half and the remaining web halves of the second bundle. When the second bundle is discharged from a conveyor upstream of the fold surface associated with the lowermost web half, the latter gravitates to an unfolded position and is thus able to travel along such fold surface.

13 Claims, 10 Drawing Figures

METHODS AND APPARATUS FOR INTERFOLDING BUNDLES OF INTERFOLDED WEBS

BACKGROUND AND OBJECTS OF THE INVENTION

This invention relates to improvements in interfolding machines in which webs of paper are interfolded into bundles which can be severed into appropriate lengths for facial tissues or other sanitary products.

Facial tissues are conventionally packaged in an interfolded relation, so that as one tissue is removed from its container, the succeeding tissue will be raised to an accessible position, and so on. Machines for interfolding webs of tissue are well known, as evidenced by Marcalus et al U.S. Pat. No. 3,850,425, dated Nov. 26, 1974, and Marcalus et al U.S. Pat. No. 4,061,325 dated Dec. 6, 1977. The first named Marcalus et al patent is particularly unique for its disclosure of a highly simplified and compact mechanism for interfolding webs of tissues, and this disclosure is incorporated by reference as if set forth at length herein. The present invention is an improvement thereon over the above-mentioned inventions.

In accordance with principles disclosed in the first named Marcalus et al patent, roll-wound webs of tissue paper are arranged in a semi-circular array, with the webs converging to a central conveying mechanism. Folding assemblies are deployed to interfold adjacent webs as the webs are pulled by the conveyor structure. Consequently, there is formed by the machine a bundle of interfolded webs of tissue paper. This web bundle is subsequently cut into stacks of appropriate lengths and a plurality of such stacks can be packaged in a typical slotted tissue container. As each tissue is withdrawn from the container, the succeeding tissue, due to ints interfolded connection with the previous tissue, is lifted to an accessible position for subsequent withdrawal.

It is desirable that the tissues be packaged in quantities of about one hundred or more per container. In order to accomplish this in an efficient manner, it is desirable to employ a plurality of interfolding machines so that a series of bundles are individually formed and deposited one upon the other to provide a bundle group containing the required number of tissues to fill a container. It will be appreciated that by merely depositing one bundle onto another, the lower web of the top bundle will not be interfolded with the upper web of the bottom bundle. At this point during tissue withdrawal there would occur a disruption in the automatic lifting of tissues to a withdrawal position. This problem is alleviated by the invention disclosed and claimed in the aforementioned Marcalus et al U.S. Pat. No. 4,061,325 in which merging stations are provided for joining bundles together. At the merging station the lower web half of the top bundle, and the upper web half of the bottom bundle, are passed along parallel surfaces which are inclined relative to vertical. At a downstream location the bundles converge and these web halves are automatically interfolded together. Thus, an interfolded relationship of all webs in the bundle group is established. In practice, it is necessary for an operator to manually position the lower and upper web halves onto the inclined surfaces. An operator is usually charged with replacing empty rolls of tissue on the interfolding machine, and threading the tissue web through the web-folding components of the machine, and thus cannot always direct sufficient attention to conditions at the merging station. Therefore, it would be advantageous if proper positioning of the upper and lower web halves could be accomplished at the merging station with minimal reliance upon the operator.

It is, therefore, an object of the present invention to deal with problems of the type noted above.

It is another object of the invention to provide novel methods and apparatus for merging bundles of webs together so that the lower web half of the top bundle and upper web half of the bottom bundle are interfolded.

It is a further object of the invention to provide such novel methods and apparatus which require minimal operator attention.

It is yet another object of the invention to provide methods and apparatus for automatically causing the lower web half of a top bundle and the upper web half of a lower bundle to be positioned along parallel inclined surfaces at a bundle merging station.

BRIEF SUMMARY OF THE INVENTION

In accordance with the present invention machines are provided for forming first and second endless bundles of interfolded paper webs. The webs are advanced in vertically spaced relationship in converging directions of travel. A first fold surface is provided for holding an uppermost web half of a bottom one of the bundles in an unfolded position as the bundles are being converged. A second fold surface is provided for holding a lowermost web half of a top one of the bundles in an unfolded position as the bundles are converged. As the uppermost and lowermost web halves are discharged from the fold surfaces they assume a mutually interfolded relationship. Mechanism is provided upstream of the first fold surface for unfolding the uppermost web half for travel along the first fold surface.

Preferably, this mechanism comprises a freely rotatable roller disposed to be engaged and frictionally rotated by the uppermost web. This roller is oriented to impart lateral forces on the uppermost web half in a direction tending to unfold the latter.

Preferably there is also provided a stationary-elongate band disposed between the lowermost web half of the top bundle and the remaining webs of that bundle. When the top bundle is discharged from a conveyor, the lowermost web half gravitates to an unfolded position for travel along the second fold surface.

THE DRAWINGS

A preferred embodiment of the invention is illustrated in the accompanying drawings in which.

Figure 4A:
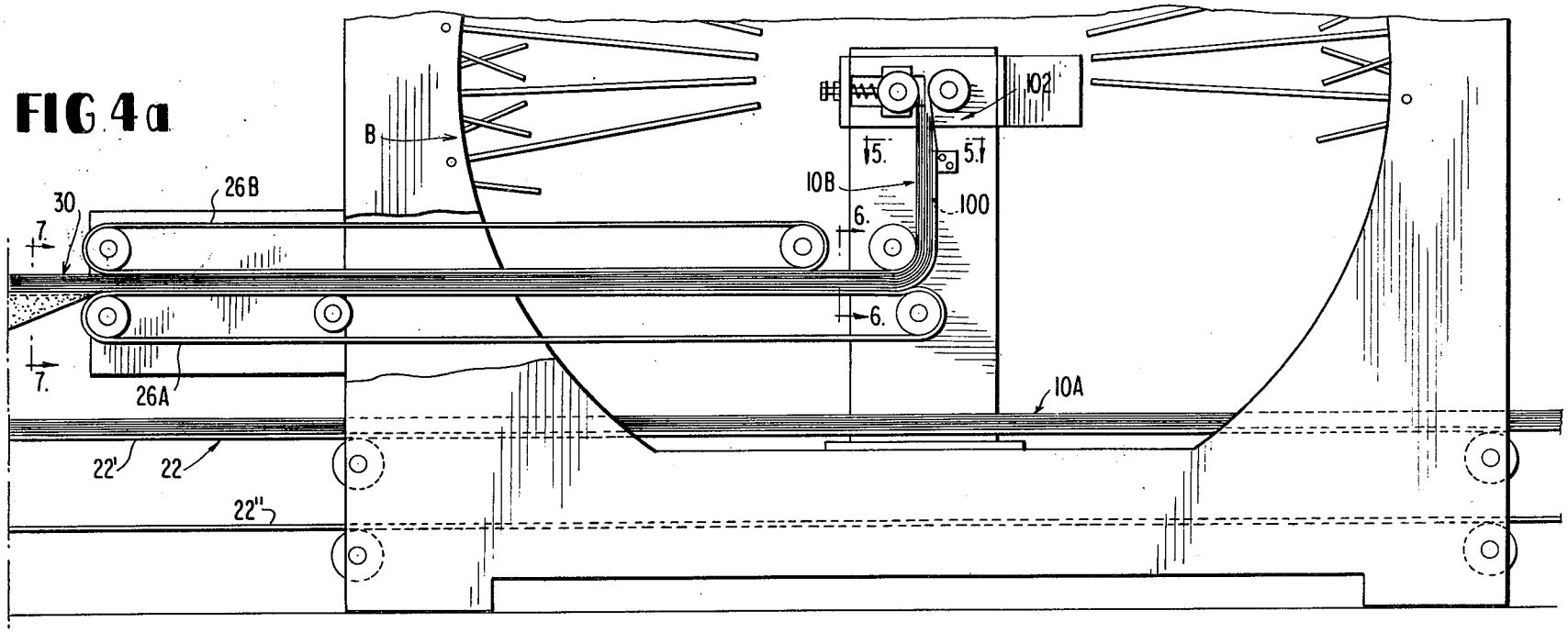
Figure 4B:
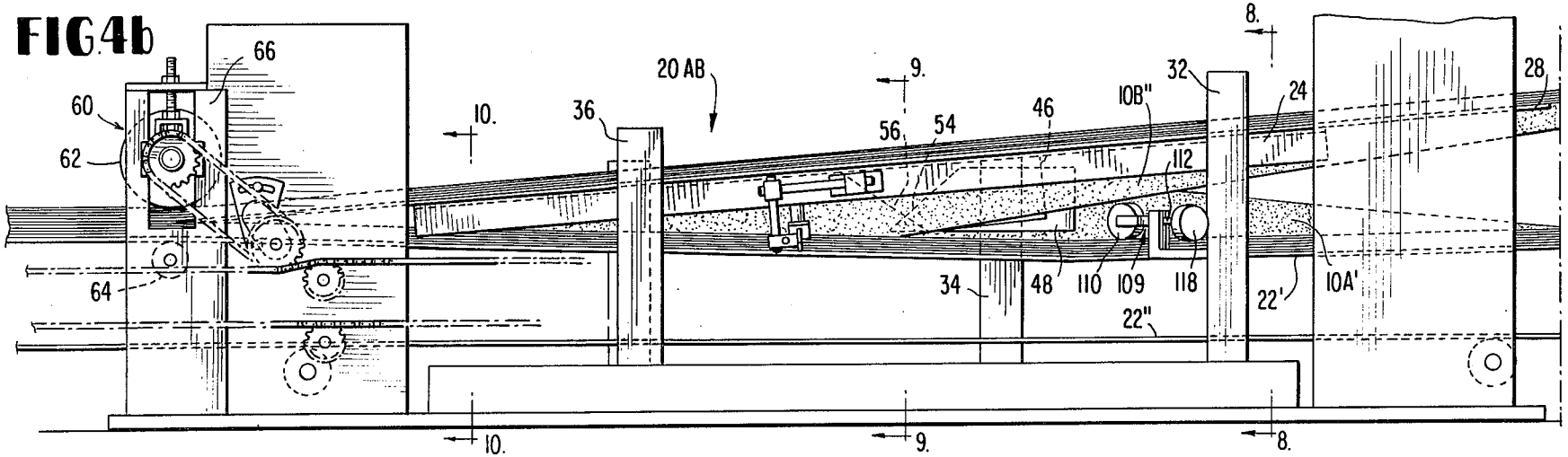

FIG. 4*a* is a side elevational view of a bundle forming machine;

FIG. 4*b* is a side elevational view depicting a bundle merging assembly located immediately downstream of the machine depicted in FIG. 4*a;*

Figure 7:
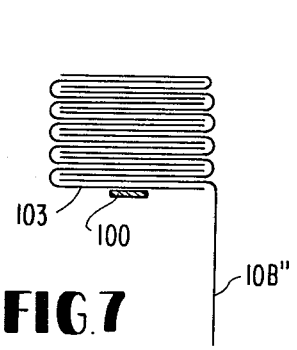
Figure 6:
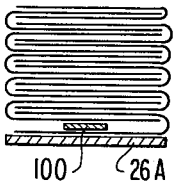
Figure 5:
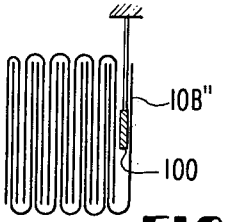

FIGS. 5 through 7 are cross-sectional views taken along lines 5—5, 6—6, and 7—7 in FIG. 4*a* depicting various conditions of a bundle as it is advanced toward the merging assembly.

Figure 8:
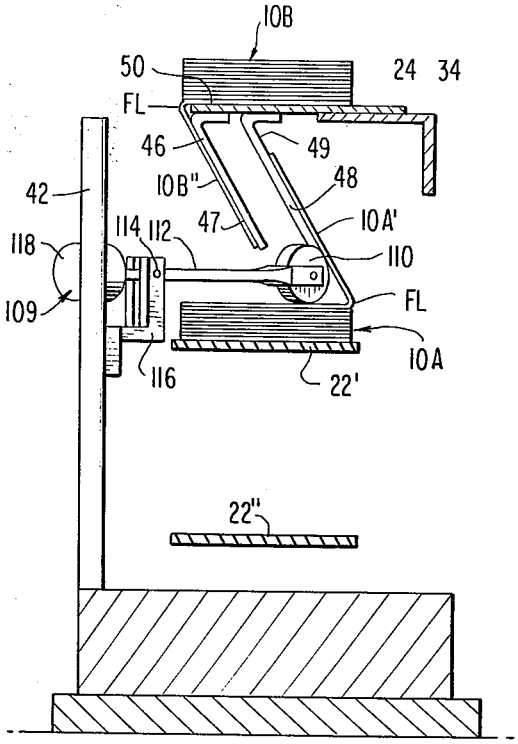
Figure 9:
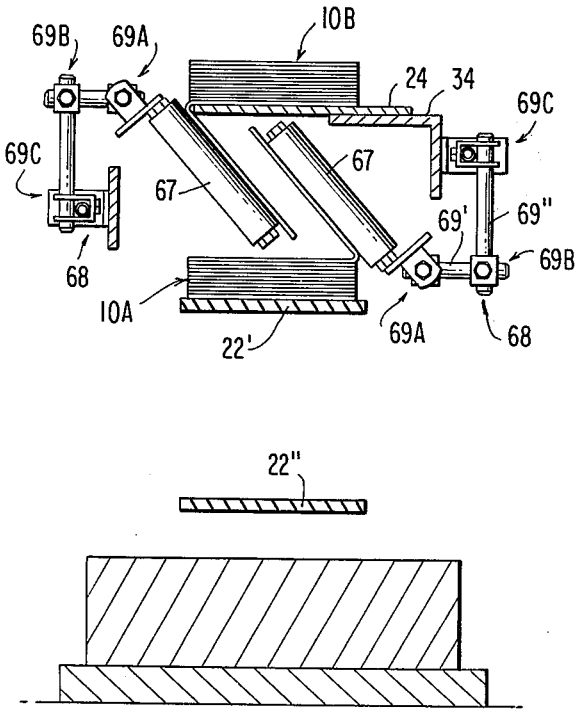
Figure 10:
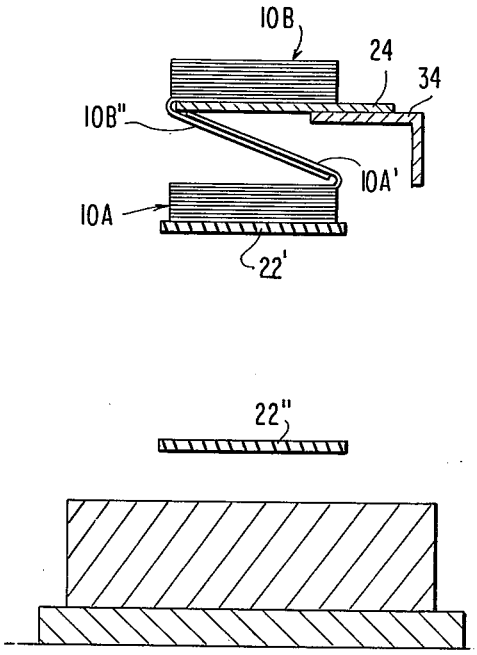

FIGS. 8 through 10 are cross-sectional views taken along lines 8—8, 9—9 and 10—10 in FIG. 4*b* depicting conditions of two bundles passing through the merging assembly.

DETAILED DESCRIPTION OF THE PREFERRED EMBODIMENT

Figure 1:
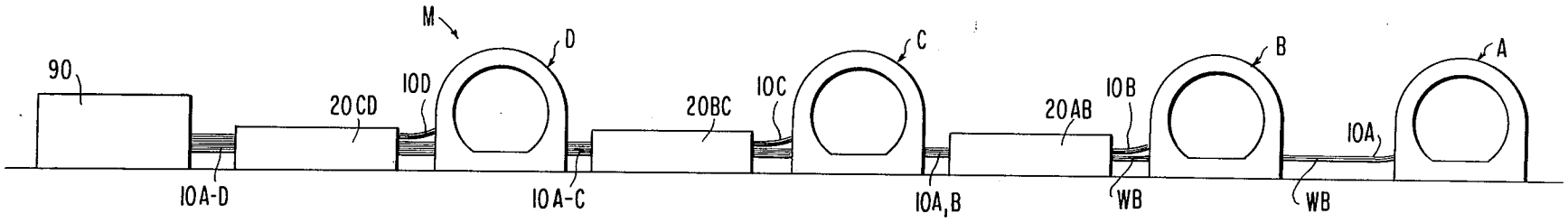
FIG. 1 is a schematic side elevational view of a bundle folding and merging machine according to the present invention.

In a preferred embodiment of the present invention, a paper folding machine comprises a plurality of essentially identical interfolding stations A, B, C, and D which are arranged sequentially of one another (see FIG. 1). Each of the interfolding stations depicted in the drawings employs an interfolding mechanism operating in accordance with principles disclosed in connection with the aforementioned U.S. Pat. to Marcalus et al, No. 3,850,425. It will be appreciated from the following discussion that the present invention may also be operable in connection with other types and arrangements of interfolding machines which produce bundles of interfolded webs.

Figure 2:
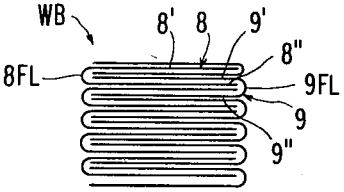
FIG. 2 is a schematic illustration depicting the interfolded condition of webs within a bundle.

Suffice it to say at this point that at each bundling station a plurality of paper webs are brought together and interfolded so as to form a bundle WB of interfolded webs which can be of the type shown schematically in FIG. 2. In that bundle arrangement, each web is folded approximately in half along a longitudinally extending fold line FL, with a top half 9' of one web 9 being interposed between the halves 8', 8" of a second web 8 located thereabove in the bundle and itself similarly folded.

Thus, at the first interfolding station A, a bundle 10A is produced, while a bundle 10B is produced at the second station B, and so forth.

In accordance with the present invention a series of bundle merging stations 20 AB, 20 BC, 20 CD are situated downstream of the second, third and fourth interfolding stations B, C, D.

The interfolding stations A–D are positioned along a main conveyor in the form of an endless belt 22 (see FIGS. 4*a*–4*b*). The belt 22 is wrapped around pulleys (not shown) spaced at the longitudinal ends of the system, with one of the pulleys being driven to drive the belt 22. The upper flight 22' of the belt 22 receives the interfolded web bundles 10A–D emitted from the various interfolding stations A–D. In this connection, the bundle 10A produced at the first interfolding station A is discharged directly onto the upper flight 22' of the main conveyor 22 and is advanced thereby toward the second interfolding station B of the series.

The bundle 10B produced at the second interfolding station B is discharged directly onto the top of the first bundle. As will be subsequently explained, this occurs as the bundles are being subjected to the action of the first merging station 20AB located between the second and third interfolding stations B, C. This merging station 20AB comprises a ramp 24 (FIG. 4*b*) whose top surface receives the second bundle 10B emitted from the second interfolding station B (FIG. 4*a*). The second bundle 10B may, for example, be discharged from the second interfolding station B by being sandwiched between a pair of driven discharge conveyors 26A, 26B (FIG. 4*a*). The upstream end 28 of the ramp 24 is spaced from the discharge conveyors 26 to establish a gap 30 exposing the lowermost web half 10B" of the bundle 10B. The ramp 24 is stationary and is affixed to any suitable support framework 32, 34, 36 situated along one side of the belt 22. The ramp 24 is forwardly and downwardly inclined so as to be convergent with the belt 22.

Suspended from the underside of the ramp 24 are downwardly projecting first and second fold plates 48, 46 (FIG. 8). The second fold plate 46 extends generally from a longitudinal edge 50 of the ramp, along which edge 50 the lowermost web fold FL of the second bundle 10B is disposed, as can be viewed in FIG. 8. The first fold plate 48 extends downwardly toward the uppermost web fold FL of the first bundle 10A. The end 52 of the first plate 48 terminates just short of the expected height of the first bundle 10A. The fold plates 46, 48 lie in generally parallel planes and are inclined inwardly of the fold lines FL of the first and second bundles 10A, 10B.

The first and second fold plates 48, 46 have outer surfaces 47, 49 arranged to guide the merging webs of the first and second bundles 10A, B. Thus the second fold plate 46 is arranged to guide the bottom-most web half 10B" of the second bundle 10B, while the first fold plate 48 is arranged to guide the top-most web half 10A' of the first bundle 10A. In this fashion, as the first and second bundle 10A, B, travel in substantially superimposed paths through the merging station 20AB, their mutually facing webs are supported by the plates in an unfolded condition.

Downstream or terminal edges of the fold plates 46, 48 are configured to facilitate an interfolding of these unfolded webs. In this connection, a terminal edge 54 of the first fold plate 48 is inclined downwardly in the direction of bundle travel, and a terminal edge 56 of the second fold plate is inclined upwardly in the direction of bundle travel (FIG. 4*b*). In this manner, the merging web halves 10A', 10B", are allowed to progressively assume a horizontal position upon leaving the fold plates 46, 48 thereby providing for a smooth, interference-free merging.

A synchronous rate of travel of the first and second bundles 10A, 10B is provided by a bundle advancing mechanism 60 disposed at the downstream end of the first merging station 20AB. This advancing mechanism 60 includes a drive roller 62 and a backing roll 64 positioned below the belt 22. The drive roll 62, and backing roll 64 define a nip zone therebetween. The drive roller is vertically adjustably mounted on a framework 66 to provide varying degrees of frictional engagement with the double bundle group 10A, B, defined by the first and second bundles 10A and 10B as they assume a fully merged or united condition. This tends to prevent bunching of the bundles as they are merged. Also, the compression of the double bundle group 10A, B, within the nip zone serves to compress the double bundle to a suitable thickness for passing through the subsequent merging station 20BC.

Importantly, the advancing mechanism 60 serves to produce sufficient tension in the bundles to maintain the webs in a taut condition, thereby facilitating the interfolding action occurring after the merging web halves leave the folding plates 46, 48.

Control over the merging web halves within each merging station is augmented by the deployment of a plurality of guide rollers 67 (FIG. 9) on both sides of the ramp 24 in the vicinity of the terminal ends 54, 56 of the first and second fold plates 48, 46. The rollers 67 are each mounted on a mounting assembly 68 that includes three clamps 69A, 69B, 69C. The clamp 69A provides adjustment of the inclination of the rollers 67 in a vertical plane. The clamp 69B adjustably receives an arm 69' of the clamp 69A and provides for horizontal shifting of the roller toward and away from the ramp 50 and divider wall 40. The clamp 69C is mounted to the stationary frame 34. An arm 69" of the clamp 69B is adjustably received in the clamp 69C. This enables the roller to be adjusted vertically, and to swing about a vertical axis. Preferably, the rollers 67 are adjusted so that their axes lie essentially parallel to the planes of the fold plates 46, 48. These rollers guide and urge together the web halves 10A', 10B", after leaving the fold plates 46, 48.

As a first bundle 10A from the first interfolding machine A approaches the first interfolding station 20AB, it is necessary that the uppermost web half of 10A' thereof be unfolded for travel along the first fold plate 48. Once this is done, such web half will continually travel along the first plate 48 until such time as an interruption occurs in the uppermost web. Such an interruption may be caused, for instance, at the first interfolding machine A when the web roll of the uppermost web 10A is depleted and must be replaced. At that time an operator inserts a new roll and threads the new web through the machine. When the leading end of this newly replaced uppermost web reaches the first merging station 20AB it must be unfolded for travel along the first fold plate 48.

Similarly, the lowermost web half 10B" of the second bundle 10B must be unfolded for travel along the second fold plate 46 at the first merging station 20AB.

It will be realized that manual performance of these unfolding operations imposes an extra burden on the operators and may increase the number of operators needed for the job.

In accordance with the present invention the need for manual unfolding of the web halves at the merging stations is eliminated. That is, the lower web half 10B" of the second bundle 10B, and the upper web half 10A' of the first bundle 10A automatically assume an unfolded condition for travel along the fold plates 46, 48.

Automatic unfolding of the second bundle 10B is promoted by an elongate metal band 100 which is arranged longitudinally beneath the second bundle 10B (FIGS. 5-7). This band or strap 100 is fastened at 101 to the frame of the second interfolding machine B so as to be held stationary relative to the second bundle 10B. The band 100 comprises a thin, narrow strip of metal or other suitable material, positioned to maintain the lower web half 10B" of the second bundle 10B separate from the remaining webs of this bundle. As is schematically shown in FIG. 4, the band is disposed between the lowermost web half 10B" and the remainder of the bundle 10B. This relationship is effected at the discharge end 102 of the interfolding machine B by an operator who simply unfolds the lowermost web half 10B" for travel beneath the band 100 in the manner depicted in FIG. 5. This operation would be performed when the web roll of the lowermost web is replaced in the interfolding machine.

Figure 3:
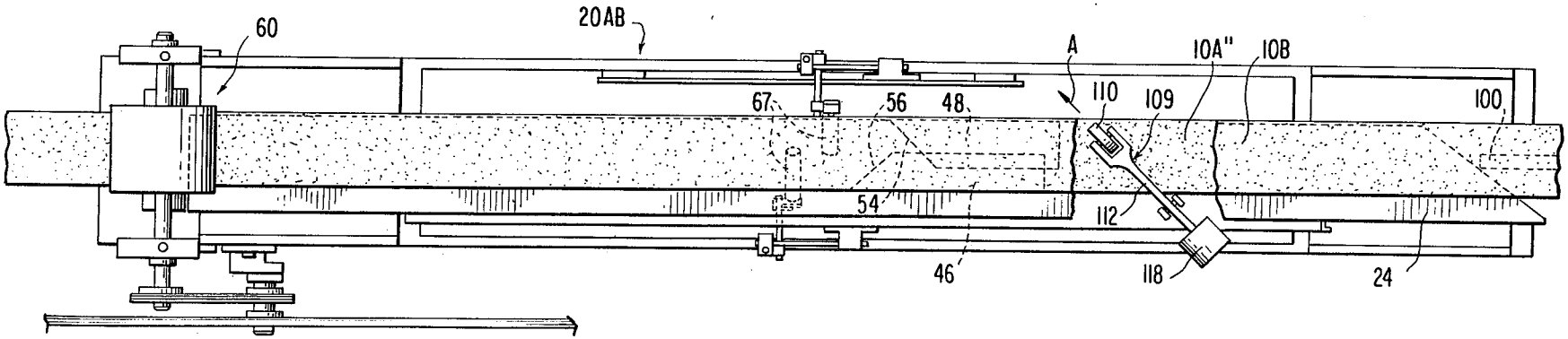
FIG. 3 is a plan view of a bundle merging assembly in accordance with the present invention.

The band 100 extends longitudinally between the conveyors 26A, B and terminates short of the ramp 28 (FIG. 3). In this fashion, as the bundle 10B is discharged from between the conveyors 26A, 26B, the lowermost web half 10B", no longer supported, gravitates to an unfolded condition (FIG. 7). The web half 103 disposed immediately thereabove is restrained by the band 100 and thus remains in a horizontal position. Accordingly, the lowermost web half 10B" is in a posture to travel against the second plate 46 at the merging station.

The band can be of any suitable dimensions, with a band 1 inch wide and 1/16 inch thick having been found suitable.

Automatic unfolding of the uppermost web half 10A' of the first bundle 10A is effected by a roller assembly 109 disposed upstream of the first fold plate 48. The roller assembly includes a freely rotatable roller 110. This roller 110 is mounted on a carrier arm 112 which is mounted for swinging movement about a horizontal axle 114. The axle 114 is rigidly carried by the frame 42 on a plate 116. A counterweight 118 is mounted at the end of the carrier arm opposite the roller. The counterweight is of such weight as to assure that the roller 110 rests upon the uppermost web half of the first bundle 10A with very light pressure, just sufficient to assure that frictional engagement of the web half 10A' against the roller rotates the latter. The roller may include a friction-maximizing coating such as rubber. The axis of the roller is disposed at an acute angle relative to the direction of travel of the uppermost web half 10A', so that as the roller rotates, somewhat laterally directed forces are exerted upon the upper web half 10A' in a direction A toward the fold axis of that web half.

Thus, as the leading end of the advancing uppermost web half 10A' reaches the roller 110, it will be urged outwardly by frictional reaction with the roller, and will thus unfold for travel along the fold plate 48.

In the event that an interruption in the uppermost web half should occur, the roller will rest upon the top half of the next web in the bundle. Since the fold line of this next web is located opposite the direction of the unfolding forces (i.e., to the left in FIG. 7—compare FIG. 2) it will be unaffected by the rotating roller.

The roller 110 may be oriented at any angle relative to the direction of travel of the first bundle 10A which is suitable for producing rotation of the roller and for unfolding the upper web half 10A'.

Subsequent to merging of the first and second bundles 10A, 10B into a double bundle group 10A-B the double bundle group 10A-B is conveyed to a second merging station 20BC to be merged with a third bundle 10C produced by the third interfolding station C. The second merging station 20BC is similar to the first merging station 20AB.

However, when merging bundles of odd-numbered webs, as opposed to even-numbered webs, it is necessary to reverse the orientation of the fold plates at the second merging station due to the fact that the fold lines of the merging web halves will be positioned at opposite sides of the conveyor 22 relative to their positioning at the first merging station.

It will be appreciated that any desired number of interfolding stations and merging stations may be provided to form a bundle group of any desired thickness.

Downstream of the last interfolding machine D a bundle severing machine 90, of conventional construction, is disposed for severing the bundle group 10A-D into sections suitable for packaging in a conventional tissue dispenser.

A first bundle 10A of interfolded webs is produced at the first interfolding station A and is discharged onto the upper flight 22' of the main conveyor belt 22. The bundle 10A is thus advanced to ward the first merging station 20AB. A second bundle 10B is produced at the second interfolding station B. The lowermost web half 10B" thereof is unfolded by an operator for travel beneath the band 100. When the leading edge of the lowermost web half 10B" is discharged from the conveyors 26A, B, this web half 10B" drops by gravity to an unfolded condition (FIG. 7). Accordingly, the web half 10B" will travel along the second fold plate 46 and will be gripped by the drive roller 62.

When the first bundle 10A reaches the merging station 20AB, the leading edge to the uppermost web half 10A' contacts and rotates the roller 110. In so doing, the roller exerts on the web half 10A' a laterally outwardly directed force in the direction A and thereby causes the web half 10A' to unfold and travel along the first fold plate 48.

As the tautly-tensioned web halves 10A', 10B", leave the terminal edges 54, 56 of the fold plates 46, 48, they gradually assume an inclined, mutually contacting relationship (FIG. 9). Eventually these halves assume horizontal, interfolded postures at the point where the second bundle 10B is deposited onto the first bundle 10A.

Subsequent to this merging action, the double bundle group 10A–B travels to the second merging station 20BC whereupon it is merged with the third bundle 10C produced at the third interfolding station C, and so on, until a bundle group of desired size has been produced for severing.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. In an apparatus for interfolding first and second endless bundles of interfolded paper webs, said apparatus being of the type comprising:

means for forming first and second bundles of interfolded webs;

means for advancing said first and second bundles in vertically spaced relation from one another and in converging directions of travel;

bundles merging means comprising:

a first fold surface for holding an uppermost web half of a bottom one of the bundles in an unfolded position as the bundles are being converged, and a second fold surface for holding a lowermost web half of a top one of the bundles in an unfolded position as the bundles are being converged, said uppermost web half normally being continuous and uninterrupted so as to automatically travel over said first fold surface and become unfolded thereby, said first and second surfaces terminating prior to mergence of said bundles so that said web halves are released into a mutually interfolded condition;

the improvement comprising unfolding means for unfolding a web half which is broken or constitutes part of a new web having no connection with a downstream upper web half, said unfolding means being disposed upstream of said first fold surface for acting upon an upper surface of a section of said uppermost web half which has no connection with a downstream web half, to unfold said uppermost web half for travel along said first fold surface.

2. Apparatus according to claim 1, wherein said means for unfolding said uppermost web half comprises a freely rotatable roller disposed to be engaged and frictionally rotated by said uppermost web, said roller being oriented to impart lateral forces on said uppermost web half in a direction tending to unfold the latter.

3. Apparatus according to claim 2, wherein said roller is mounted at one end of an arm, said arm being mounted for free pivotal rotation about a horizontal axis.

4. Apparatus according to claim 3, wherein a counterweight is mounted at the other end of said arm to regulate the contact pressure between said roller and said uppermost web half.

5. Apparatus according to claim 1, further including means disposed upstream of said second fold surface for permitting said lowermost web half to gravitate to an unfolded condition for travel along said second fold surface, while constraining the remaining web halves against such gravitation.

6. Apparatus according to claim 5, wherein said means for permitting said lowermost web half to gravitate comprises a stationary elongate band extending between said lowermost web half and a remaining portion of said second bundle.

7. Apparatus according to claim 6, including conveying means engaging the top and lowermost web halves of said second bundle for conveying said second bundle toward said merging means, said conveyor means terminating ahead of said second fold surface so that said lowermost web half unfolds, while said band retains the remainder of said web bundle.

8. Apparatus according to claim 1, wherein said first and second fold surfaces comprise first and second fold plates, respectively, said plates disposed vertically intermediate said first and second bundles, said fold plates being inclined relative to vertical and lying in generally mutually parallel planes; said first fold plate being arranged to guide the top web of said first bundle in an upwardly unfolded condition during advancement of said first bundle; and said second fold plate being arranged to guide the bottom web of said second bundle in a downwardly unfolded condition during advancement of said second bundle; said first and second fold plates terminating prior to depositing of said second bundle onto said first bundle.

9. Apparatus for interfolding first and second bundles of interfolded paperous webs comprising:

a conveyor for advancing said first bundle;

means for advancing said second bundle in overlying relation relative to said first bundle;

a ramp for supporting said second bundle, said ramp converging forwardly downwardly toward said first bundle;

a first fold surface being inclined upwardly and inwardly from an edge of said first bundle where the fold line of the uppermost web thereof is located;

a second fold surface being inclined downwardly and inwardly from an edge of said second bundle where the fold line of the lowermost web thereof is disposed;

said first and second fold surfaces being arranged to guide an uppermost web half of said first bundle and a lowermost half of said second bundle, respectively, in an unfolded condition as said first and second bundles converge toward one another;

a roller disposed upstream of said first fold surface and arranged to rest upon said first bundle, said roller being freely rotatable so as to be driven by frictional contact with said uppermost web half;

said roller being oriented toward the fold line of said uppermost web half so that said frictional drive forces react against said uppermost web half to unfold the latter for travel along said first fold surface.

10. Apparatus according to claim 9 further including a stationary elongate band disposed between said lowermost web half of said second bundle and the remainder of said second bundle; said advancing means including conveyor means upon which said second bundle travels; said last-named conveyor means terminating short of said second fold plate enabling said lowermost web half to gravitate to an unfolded condition while the remainder of said second bundle is restrained by said band.

11. A method for interfolding first and second endless bundles of interfolded webs, the method comprising the steps of:

forming a first and second endless bundles of interfolded webs;

advancing said endless bundles in vertically spaced directions of travel such that one bundle constitutes a top bundle and the other bundle constitutes a bottom bundle;

contacting an upper surface of a folded uppermost web half of said bottom bundle with a freely rotatable roller which is disposed upstream of a first fold surface and oriented with its rotary axis at an acute angle relative to the direction of bundle travel of a portion of said roller contacting said upper surface has a component in the direction of bundle travel such that said roller is driven by said upper surface, and a component in the direction of a fold line of said uppermost web half thereby causing said uppermost web half to unfold and travel along the first fold surface;

causing a lowermost web half of said top bundle to be unfolded and travel along a second fold surface, progressively merging said bundles vertically together; and releasing said web halves from said fold surfaces prior to final merging of the bundles, allowing such web halves to assume a mutually interfolded position.

12. A method according to claim 11, wherein said step of causing said lowermost web half to be unfolded comprises the steps of advancing said top bundle along a conveyor with an elongate band disposed between said lowermost web half and a remainder of said top bundle, discharging said top bundle from said conveyor upstream of said second fold surface so that said lowermost web half gravitates to an unfolded position while said band constrains the remainder of said top bundle.

13. Apparatus for interfolding first and second endless bundles of interfolded paper webs comprising:

means for forming first and second bundles of interfolded webs;

means for advancing said first and second bundles in vertically spaced relation from one another and in converging directions of travel;

bundles merging means comprising:

a first fold surface for holding an uppermost web half of a bottom one of the bundles in an unfolded position as the bundles are being converged; and a second fold surface for holding lowermost web half of a top one of the bundles in an unfolded position as the bundles are being converged, said first and second surfaces terminating prior to mergence of said bundles so that said web halves are released into a mutually interfolded condition; and means for unfolding an upper surface of said uppermost web half comprising a freely rotatable roller disposed upstream of said first fold surface and arranged in contact with said upper surface of said uppermost web half to be frictionally rotated by the latter, said roller being oriented to impart lateral forces on said uppermost web half in a direction tending to unfold said uppermost web half for travel along said first fold surface.

* * * * *